US005078306A

United States Patent [19]

Keller et al.

[11] Patent Number: 5,078,306

[45] Date of Patent: Jan. 7, 1992

[54] REFRACTORY VALVE UNIT FOR CONTROLLING THE DISCHARGE OF MOLTEN METAL IN A METALLURGICAL VESSEL

[75] Inventors: Werner Keller, Steinhausen; Rolf Waltenspuhl, Hunenberg, both of Switzerland

[73] Assignee: Stopinc AG, Baar, Switzerland

[21] Appl. No.: 608,011

[22] Filed: Nov. 1, 1990

Related U.S. Application Data

[63] Continuation of Ser. No. 414,527, Sep. 29, 1989, abandoned.

[30] Foreign Application Priority Data

Sep. 29, 1988 [CH] Switzerland ..... 03629/88

[51] Int. Cl.[5] ..... B22D 41/14

[52] U.S. Cl. ..... 222/598; 222/591

[58] Field of Search ..... 222/598, 599, 591, 597; 266/236

[56] References Cited

U.S. PATENT DOCUMENTS

| | | | |
|---|---|---|---|
| 1,742,065 | 12/1929 | Eiser | 222/599 |
| 3,344,965 | 10/1967 | Kerin | 222/599 |
| 4,840,295 | 6/1989 | Hartley | 222/598 |
| 4,913,324 | 4/1990 | Lührsen et al. | 222/598 |
| 4,949,886 | 8/1990 | Lührsen et al. | 222/599 |

FOREIGN PATENT DOCUMENTS

| | | | |
|---|---|---|---|
| 0362215 | 2/1989 | European Pat. Off. | 222/599 |
| 0308597 | 3/1989 | European Pat. Off. | 222/598 |
| 0183241 | 7/1922 | United Kingdom | 222/599 |

*Primary Examiner*—S. Kastler

*Attorney, Agent, or Firm*—Wenderoth, Lind & Ponack

[57] ABSTRACT

A unit for controlling the discharge of molten metal from a metallurgical vessel includes a valve having a refractory stator fixed to refractory material of the unit constituting lining of the vessel and a refractory rotor disposed in the stator and movable relative to the stator between open and closed positions of the valve. The stator and the rotor have flow control passageways extending therein which can place the interior of the metallurgical vessel in communication with a discharge opening of the valve. A seal is established between the stator and the rotor over a portion thereof that surrounds the flow control passageways such that molten metal may not pass from the flow control passageways into an area between the stator and the rotor. Furthermore, a gap extends over the entire thickness of the refractory material between the stator and the rotor for accommodating for differences in the thermal expansion of the stator and the rotor during the discharging of molten metal through the valve to prevent the valve from jamming during the use thereof.

24 Claims, 4 Drawing Sheets

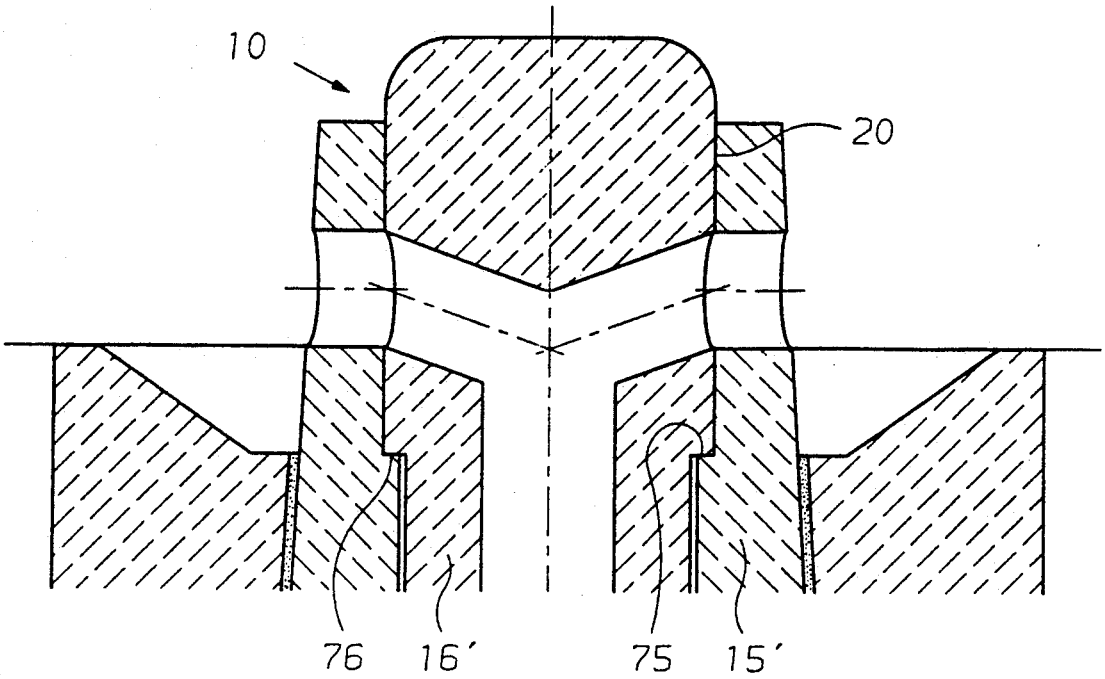
Fig. 9
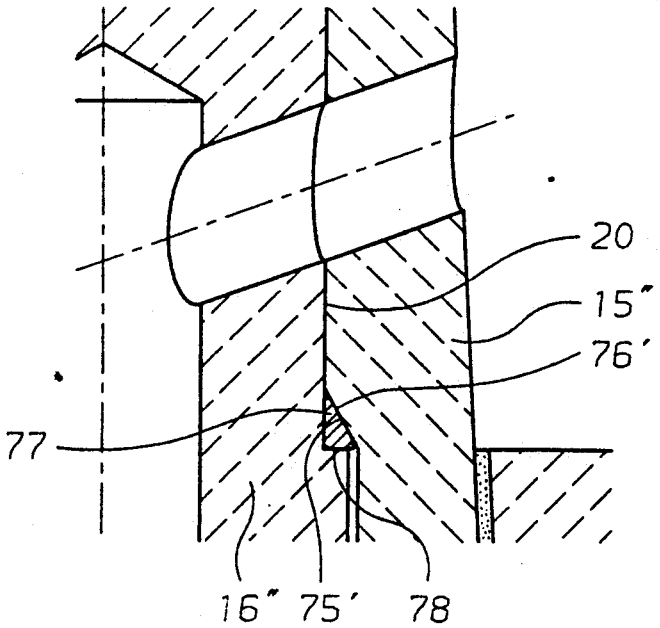

REFRACTORY VALVE UNIT FOR CONTROLLING THE DISCHARGE OF MOLTEN METAL IN A METALLURGICAL VESSEL

This application is a continuation of now abandoned application, Ser. No. 07/414,527 filed on Sept. 29, 1989, now abandoned.

BACKGROUND OF THE INVENTION

1. Field of the Invention

The present invention relates to a unit for controlling the discharge of molten metal in a substantially downward direction from a metallurgical vessel, which unit includes a valve comprising a refractory stator fixed to refractory lining of the metallurgical vessel, and a refractory rotor disposed in the stator and being longitudinally slidable and/or rotatable relative to the stator for opening or closing the valve. When the unit is in place in the metallurgical vessel, the valve projects into the molten metal within the vessel. The valve defines a discharge opening therein open at one side of the refractory lining of the metallurgical vessel and flow control passageways which may place the interior of the metallurgical vessel in communication with the discharge opening so that molten metal may be discharged through the valve from the metallurgical vessel.

2. Description of the Related Art

U.S. Pat. No. 3,651,998 discloses a valve of the aforementioned type comprising a stator fixed to the refractory lining of a metallurgical vessel and extending into the vessel, and a rotatable rotor mounted concentrically in the stator. The rotor is forced against a closed top end of the stator by springs exerting a force on the bottom of the rotor. When the valve is open, molten metal flows through several transverse passageways into a central discharge opening defined in the rotor and then out of the valve. Since a relatively large clearance is provided between the rotor and the stator, the gap formed between the rotor and the stator can hardly prevent molten metal from flowing between the stator and the rotor even when gas is introduced into the gap. Molten metal passing between the rotor and the stator can harden very rapidly and cause the rotor to jam. Furthermore, a tensile force exerted on the stator by the springs via the rotor is undesirable since the refractory material of the stator can withstand only small tensile forces and is, moreover, somewhat weak due to a plurality of transverse flow control passageways extending therethrough.

A valve for controlling the discharge of molten metal from a metallurgical vessel is also disclosed in DE-PS 35 40 202 and comprises two concentric pipes. The inner pipe extends through a discharge opening in the vessel and the outer pipe is slidingly fitted over the inner pipe. The inner and outer pipes each have a flow control passageway extending therethrough. By rotating and moving the outer pipe longitudinally relative to the inner pipe, the flow control passageways of the pipes can be aligned to discharge the molten metal from the vessel in a controlled manner. In such a valve, a relatively expensive mechanism above the vessel is required to rotate the outer pipe. Such a mechanism cannot exert any transverse forces on the outer pipe without risking the possibility of the inner pipe breaking. If the metallurgical vessel is an intermediate vessel, space conditions are usually quite restricted due to the disposition of a ladle directly above the intermediate vessel, such an arrangement being undesirable.

SUMMARY OF THE INVENTION

An object of the present invention is to provide an improved unit of the above-mentioned type that is simple and compact while exhibiting a high degree of reliability.

To achieve the above object, in the valve of the present invention a seal is established between the stator and the rotor over substantially the entire portion of the stator and the rotor that extends on one side of the refractory lining of the vessel, i.e. that would extend into the metallurgical vessel when in place, whereas a gap is defined in the valve over the entire thickness of the refractory lining between the stator and the rotor for accommodating for differences in the thermal expansion of the stator and the rotor during the discharging of molten metal through the valve to prevent the valve from jamming during use.

Such a combination of features of the present invention results in a unit that is significantly different from the prior art. A very small space-saving drive can be integrally connected to the rotor at one side of the refractory lining, i.e. at the undersurface of the metallurgical vessel, because there is practically no tension between the rotor and the stator. Both the seal established between cylindrical surfaces of the stator and the rotor and the gap defined between the stator and the rotor result in a unit that is very well adapted to operate reliably in a steel mill. To ensuredly prevent the unit from jamming, the inner surface of the stator extending over the thickness of said refractory lining and defining the gap with said rotor has a diameter that is larger than the diameter of the sealing surface of the stator and/or the outer surface of the rotor extending over the thickness of the refractory lining and defining said gap with the stator has a diameter that is less than the diameter of the sealing surface of the rotor. With such structure, wide variations in the thermal expansion of the stator and the rotor are accommodated for. And, if the gap between the stator and the rotor is at least a few tenths of a millimeter, when transverse forces act on the rotor, the rotor is nevertheless guided by the stator and will not be broken by such transverse forces.

In a preferred embodiment of the invention, the rotor is disposed concentrically within the stator and has a central discharge opening extending therethrough and a flow control passageway comprising at least one transverse opening which can place the discharge opening in communication with the interior of the metallurgical vessel. On the other hand, the stator may be designed as a sleeve in which the rotor is fitted. Such features of the present invention yield a unit which can be manufactured cost efficiently.

When pouring pipes are used below units for controlling the discharge of molten metal from a metallurgical vessel, it is preferable that such pipes be connected to a stationary part of the valve of such a unit. In order to provide such a feature according to the present invention, the stator can be provided with a discharge opening open at the exterior of the metallurgical vessel and a transverse flow control passageway open to the discharge opening. The rotor is mounted within the stator and also has a flow control passageway therein, the rotor being rotatable and/or slidable longitudinally within the stator to align the flow control passageways of the stator and the rotor to place the discharge opening of the stator in communication with the interior of the metallurgical vessel.

Also, according to the invention, an inert gas-feeding passageway may be defined in the valve at the bottom of the stator and the rotor for allowing inert gas to be fed therethrough between the rotor and the stator so as to substantially prevent air from being sucked into the molten metal.

The flow control passageway in the stator is spaced, as take in the direction of the thickness of the refractory lining, a distance from the refractory lining that is sufficient to prevent cold and polluted molten metal that settles directly above the refractory lining from flowing into the valve.

According to another preferred form of the invention, when the unit is in place in the metallurgical vessel, the stator extends vertically into the vessel; however, the present invention also contemplates the valve extending horizontally into the vessel from a side wall of the vessel especially for use in discharging molten aluminum from the vessel.

In another preferred embodiment of the invention, the stator has at least one annular groove extending therein and open at the cylindrical surfaces of the stator and the rotor below the transverse flow control passageway of the stator, i.e. at a location between the flow control passageway of the stator and the refractory lining. At least one radial opening extends in the stator between and open to the annular groove and the interior of the metallurgical vessel. Thus, although molten metal flowing through the flow control passageways of the stator or the rotor usually cause a subpressure which tends to induce the suction of outside air, such a subpressure is relieved due to the formation of the annular groove and the at least one radial opening thereby inhibiting the suction of air.

BRIEF DESCRIPTION OF THE DRAWINGS

The present invention will be explained in more detail below with reference to the accompanying drawings, in which:

FIGS. 8 and 9 are partial schematic longitudinal sectional views of other modified versions of the unit according to the present invention.

DETAILED DESCRIPTION OF THE PREFERRED EMBODIMENTS

Figure 1:
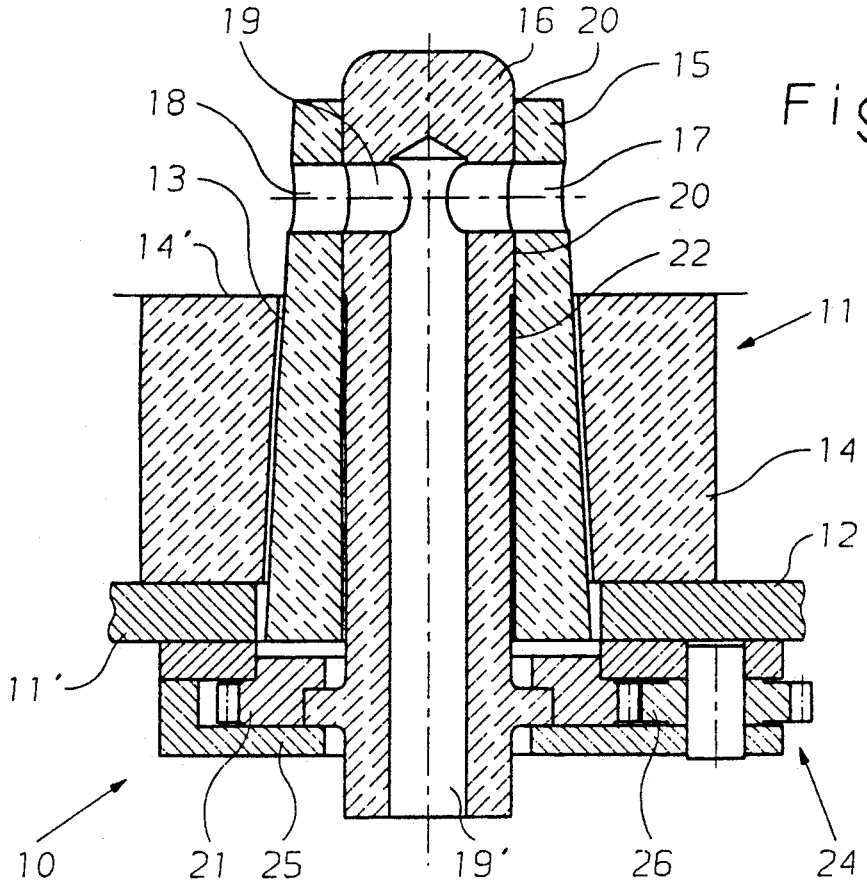
FIG. 1 is a schematic longitudinal sectional view of a unit for controlling the discharge of molten metal from a metallurgical vessel according to the present invention.

Referring to FIG. 1, a valve 10 of the unit according to the present invention is disposed in the nozzle 13 extending through refractory wall lining 14 of a metallurgical vessel 11 (partially illustrated). The metallurgical vessel may comprise a steel shell 12 and the remaining refractory lining and/or can comprise a ladle and an intermediate vessel. The valve 10 essentially comprises a refractory stator fixed to refractory lining 14, a refractory rotor 16 that is disposed within and rotatable relative to the stator, and a drive mechanism 24.

The rotor 16 is maintained in a housing 25 and is integrally connected to a rotating gear 21 which is driven in a controlled manner by a drive motor (not shown) via a pinion 26. The gear 21, pinion 26 and drive motor constitute the drive mechanism 24 of the present invention. In the embodiment shown, the stator 15 is a sleeve having a conical outer surface which allows the stator to be easily mounted to the refractory wall lining 14 within nozzle 13. The stator extends through the refractory wall lining 14 to a side thereof corresponding to the interior of the vessel 11. The stator has a flow control passageway therein formed by two transverse openings 17 and 18 which are round but can have other cross-sectional shapes such as being elongate in a horizontal or vertical direction. The rotor 16 is disposed concentrically within the stator 15 and is rotatable relative to the stator from one side of the refractory wall lining 14, i.e. from the bottom 11' of the metallurgical vessel 11. The rotor may also be slidable and/or rotatable relative to the stator. The rotor 16 has a blind bore 19' extending axially therein and a flow control passageway formed by transverse openings 19 that may be aligned with transverse openings 17 and 18 to discharge molten metal from the vessel. The openings 17 and 18 are spaced, as taken in the direction of thickness of the refractory lining 14, at least 20 mm from the surface 14' of the refractory wall lining 14, and preferably approximately between 20 and 70 mm from surface 14'. In FIG. 1, the valve is shown in an open position in which molten steel can flow, for example, through openings 17, 18 and 19 into a mold in a controlled manner. The rotor can also be designed as an immersion pipe extending just into the molten metal within the mold.

In accordance with the invention, a seal 20 is established between the cylindrical sealing surfaces of the stator 15 and rotor 16 over a portion thereof that surrounds the flow control passageways 17, 18. The portion of the stator and rotor at which the seal 20 is established is, as shown in the figures, substantially the entire portion of the stator and the rotor that extends to a side of the refractory wall lining 14, i.e. the entire confronting portion of the stator and rotor that is disposed in the metallurgical vessel 11. On the other hand, a gap 22 extends, over the entire thickness of the refractory wall lining 14, between the stator and the rotor for accommodating for differences in the thermal expansion of the stator 15 and the rotor 16 during the discharging of molten metal through the valve 10 to prevent the valve from jamming during use. The gap 22 is at least a few tenths of a millimeter and not only allows the rotor to be moved relative to the stator relatively easily by accommodating for differences in the thermal expansion of the stator and the rotor during use as mentioned above, but also still allows the stator 15 to act as a guide for the rotor over the portion thereof at which gap 22 is defined.

Figure 2:
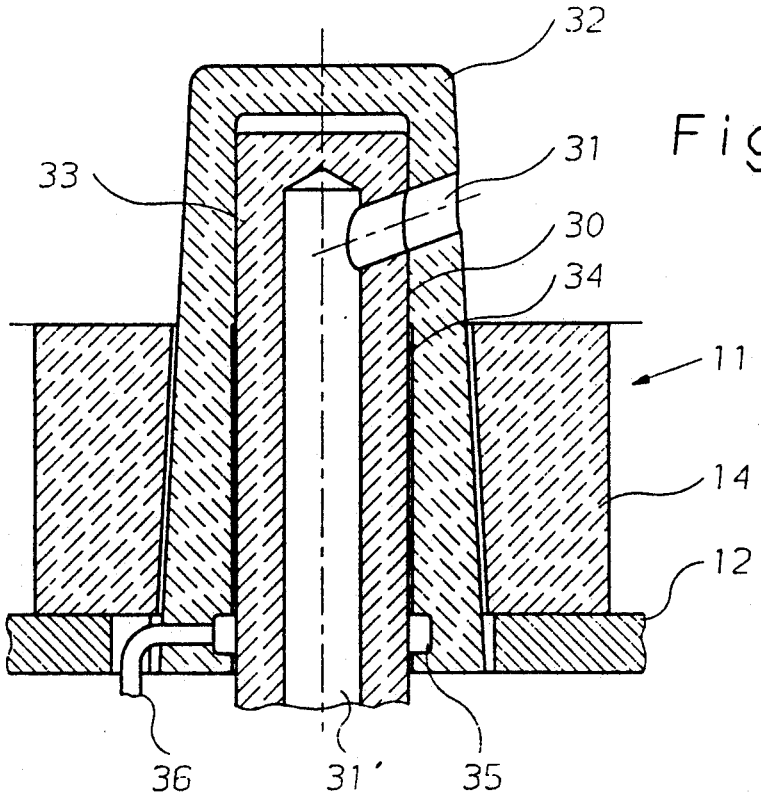
FIG. 2 is a schematic longitudinal sectional view of another unit according to the present invention.

FIG. 2 shows another unit according to the present invention which is similar to that shown in FIG. 1. However, according to the embodiment of FIG. 2, only one flow control passageway 31 is provided in the stator 32 which may place the interior of the metallurgical vessel in communication with discharge opening 31'. Further, the stator has a closed top end extending over the rotor. Again, a seal 30 is established between the stator 32 and the rotor 33 over nearly the entire portion thereof that surrounds the flow control passageways and extends in the metallurgical vessel 11.

Also, the inner surface of the stator which extends over the thickness of the refractory wall lining 14 and defines the gap 34 with the rotor has a diameter that is larger than the diameter of the cylindrical sealing surface of the stator at which seal 30 is established. This is different from the FIG. 1 embodiment in which the outer surface of the rotor 16 extending over the thickness of the refractory wall lining 14 and defining the gap 22 with the rotor has a diameter that is less than the diameter of the sealing surface of the rotor at which seal 20 is established.

Again referring to FIG. 2, an annular slot 35 and a passageway 36 are defined in the valve so as to constitute an inert gas-feeding passageway therein open to gap 34 for allowing inert gas, for example argon, to be fed therethrough to prevent air from being introduced into the valve. The inert gas-feeding passageway is thus defined at the bottom end of the inner peripheral surface of the stator. And, although the flow control passageways of the stator and the rotor are shown as being inclined downwardly into the discharge opening 31', the same can be disposed orthogonally to the discharge opening 31'.

Figure 3:
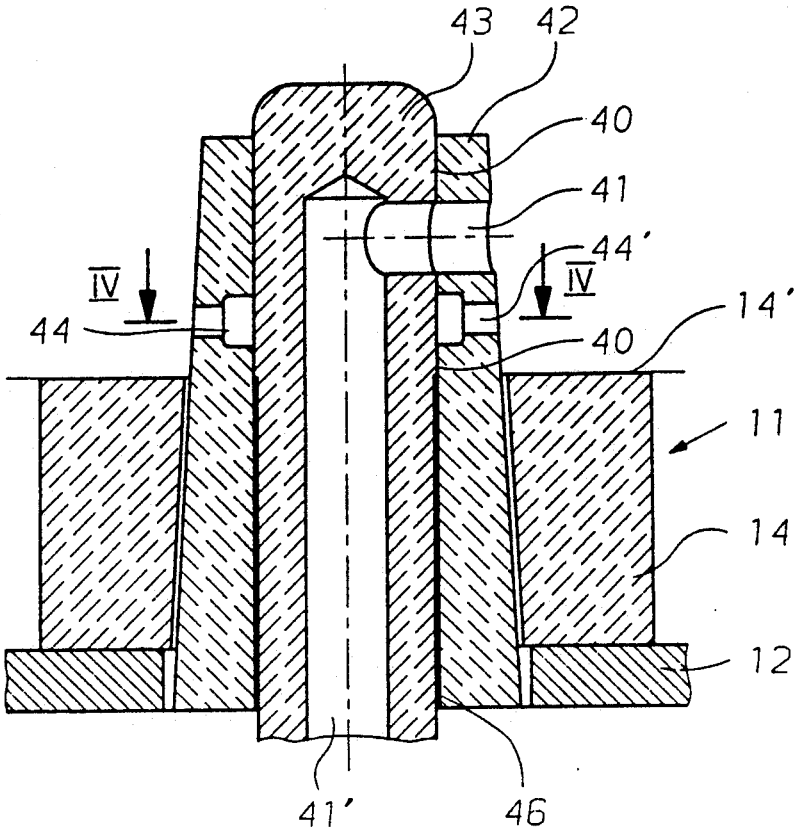
FIG. 3 is a schematic longitudinal sectional view of yet another unit according to the present invention.
Figure 4:
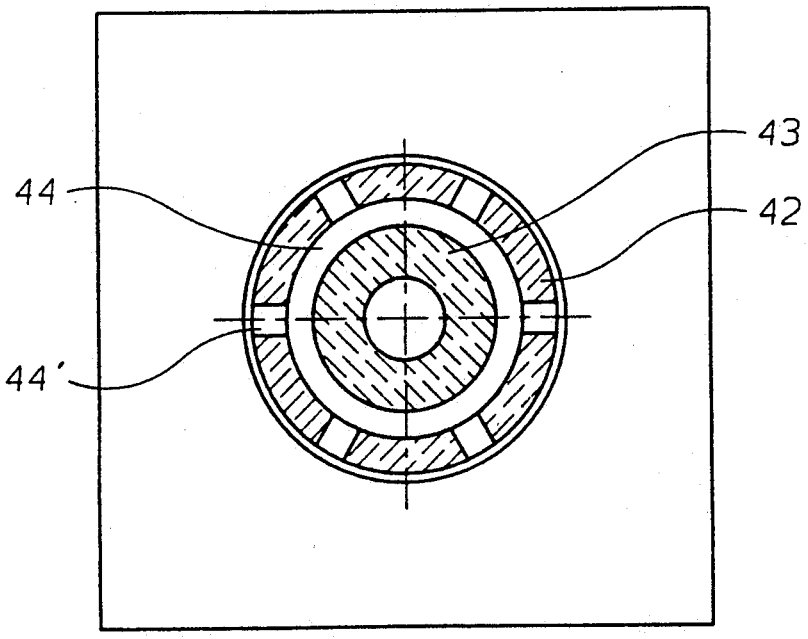
FIG. 4 is a cross-sectional view of the unit of FIG. 3 as taken along line IV—IV in FIG. 3.

In the embodiment shown in FIGS. 3 and 4, the stator 42 has the shape of a sleeve and is embedded in the refractory wall lining 14 while rotor 43 is disposed within the stator 42 and is rotatable relative to the stator. A transverse opening 41 constituting a flow control passageway extends through the stator 42 and may be placed in communication with a discharge opening 41' extending in rotor 43 so as to enable the discharge of molten metal from the metallurgical vessel 11. According to another feature of the present invention, the stator 42 has an annular groove 44 extending therein and open at the cylindrical surfaces of the stator and the rotor at which a seal 40 is established. The annular groove 40 is located between the flow control passageway 41 and the refractory wall lining 14. At least one radial opening 44' extends between and is open to the annular groove 44 and the exterior of the valve. The seal 40 established between the stator and the rotor prevents molten metal from flowing from flow control passageway 41 into the area between the stator and the rotor and also prevents molten metal from flowing through radial passageways 44' and annular groove 44 to the area between the stator and the rotor. The annular groove 44 and radial passageways 44' serve to inhibit the induction of air as discussed above under the Summary of the Invention. The gap 46 in this embodiment is defined by the outer surface of the rotor which extends over the thickness of the refractory lining and has a diameter that is less than the diameter of the sealing surface of the rotor at seal 40.

Figure 5:
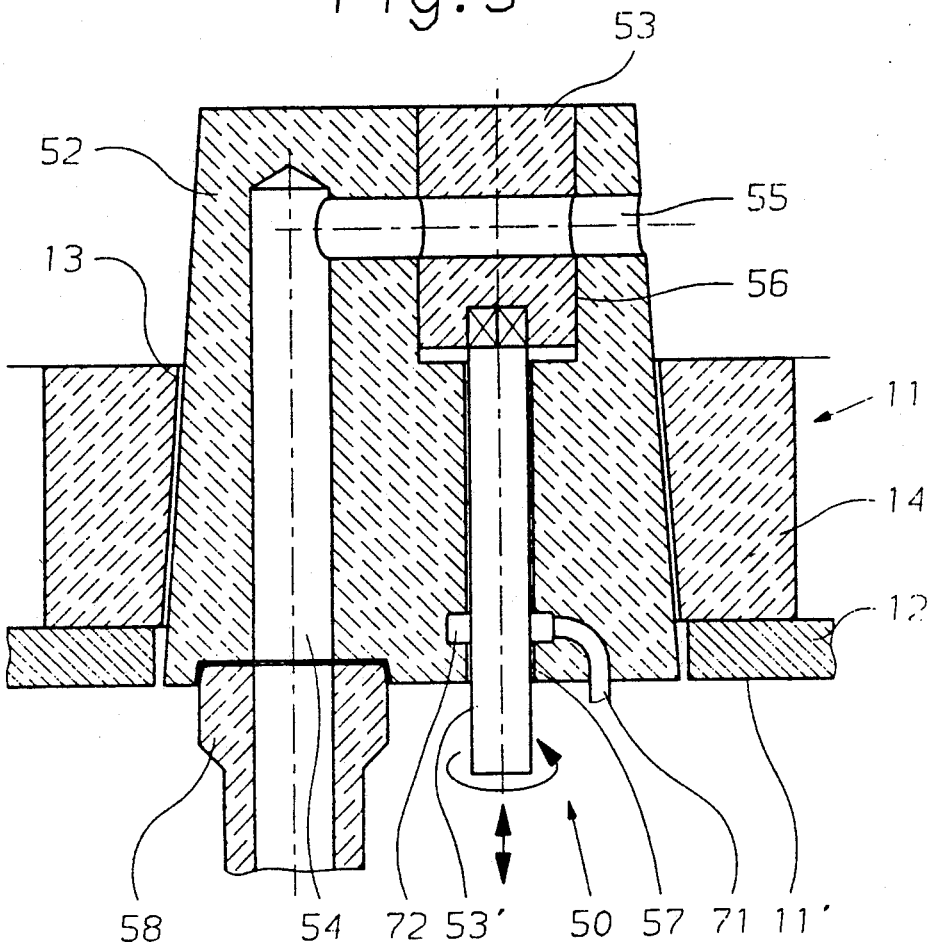
FIG. 5 is a schematic longitudinal sectional view of another unit according to the present invention.

In the embodiment of FIG. 5, a valve 50 according to the present invention comprises a stator 52 having the shape of a frustum which is cemented to the refractory wall lining 14 within nozzle 13 of the metallurgical vessel 11 which in this case may be a ladle. The stator 52 has a blind bore 54 extending therein constituting a discharge opening of the valve and a transverse opening open to the bore 54 and constituting a flow control passageway 55 of the stator 52. A rotor 53 is disposed in the stator 52 in operative association with flow control passageway 55. The rotor 53 can be rotated and/or longitudinally slid relative to the stator 52 via a drive shaft 53' of the rotor which extends through the stator 52 and is coupled to a drive mechanism (not shown) disposed beneath the metallurgical vessel 11.

As in the previous embodiments, a seal 56 is established by cylindrical engaging surfaces of the stator and the rotor at substantially the entire portion of the stator and the rotor that extends to the side of the refractory wall lining 14 corresponding to the interior of the metallurgical vessel. Furthermore, a gap 57 extending over the entire thickness of the refractory wall lining 14 is provided for preventing the shaft 53' of the rotor from jamming.

Other features of the embodiment shown in FIG. 5 include a pouring pipe 58 which is to extend into the molten metal of a mold and having an opening therein aligned with the discharge opening 54 of the stator, and an inert gas-feeding passageway 71, 72 open to gap 57 for the same reasons discussed above with regard to the inert gas-feeding passageway 35, 36 of the FIG. 2 embodiment.

Figure 6:
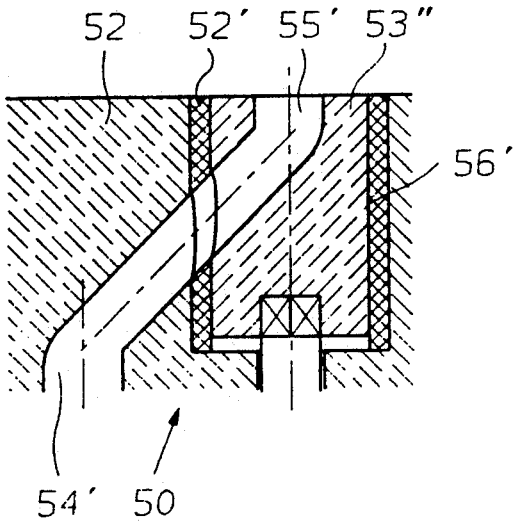
FIGS. 6 and 7 are schematic longitudinal sectional views of modified portions of the unit shown in FIG. 5 according to the present invention.

FIG. 6 shows a modified version of the FIG. 5 embodiment in which stator 52 includes a high grade refractory insert 52' defining the cylindrical sealing surface of the stator 52 which engages the cylindrical sealing surface of the rotor 53'' so as to establish the seal 56' between the stator and the rotor. The insert 52' is preferably embedded into the poured refractory material of the stator 52 which can be reworked so as to increase the service life of the stator 52.

Also, the flow control passageway 55' of the rotor 53'' is open to the exterior of the valve at the center of an end face of the rotor 53'' and is open to the cylindrical sealing surface of the insert 52' of stator 52 so as to be alignable with the flow control passage of the stator 52 extending contiguously with the discharge opening 54'.

Figure 7:
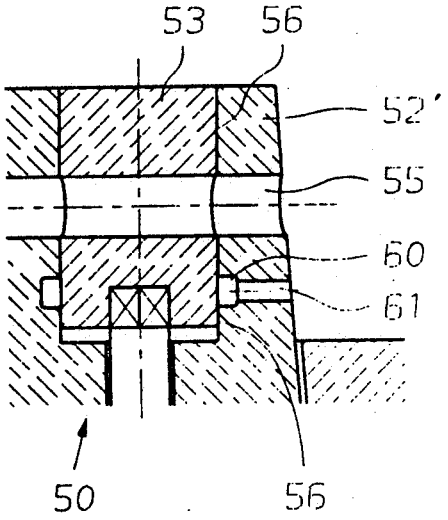

In FIG. 7, below flow control passage 55 of stator 52' is defined an annular groove 60 and at least one radial passageway 61 open thereto. The annular groove 60 is, as in the embodiment of FIG. 3, open to the cylindrical sealing surface of the stator 52' which establishes the seal 56 with the cylindrical sealing surface of stator 53. As discussed above, this prevents undesired air from being sucked into the molten metal in flow control passageway 55 and prevents molten steel from being reoxidized.

FIG. 8 shows yet another embodiment of the valve 10 according to the present invention in which the stator 15' and the rotor 16' have respective annular surfaces 75, 76 which extend orthogonally to the cylindrical sealing surfaces at which seal 20 is established. The annular surfaces 75, 76 contact each other to establish yet another seal between the stator 15' and rotor 16'. Such an additional sea increases the effectiveness in preventing molten metal from flowing into the gap extending over the entire thickness of the refractory lining between the stator and the rotor.

The embodiment of FIG. 9 is different from the embodiment of FIG. 8 in that annular sealing surfaces 75', 76' are inclined at an acute angle, preferably between 30° and 60°, with respect to the cylindrical sealing surfaces at which seal 20 is established. The rotor 16'' has a annular joint 77 extending therearound which comprises refractory material having a low coefficient of friction, such as graphite. This circumferential joint 77, during assembly, is slid over the rotor 16'' and comes to rest on an annular stop surface 78 of the rotor 16''. The annular joint 77 could, of course, be provided by embedding the same in the stator. In the embodiments of FIG. 8 and FIG. 9, the stators and rotors are preferably forced against one another to generate a slight bearing pressure (a few kilograms) at the annular sealing surfaces.

The present invention has been described in detail above with respect to preferred embodiments thereof. However, various changes and modifications will become apparent to those of ordinary skill in the art. For example, although the embodiments of the present invention have been described in terms of units that are particularly applicable to discharging molten steel in a substantially downward direction from a metallurgical vessel, the present invention is applicable to metallurgical vessels from which relatively light molten metal is to be discharged in which case the valves of the present invention would be built into the side refractory wall lining of the vessel so as to extend horizontally. Such a modification, and others, are seen to fall within the true spirit and scope of the invention which is defined by the appended claims.

What is claimed is:

1. A unit for controlling the discharge of molten metal from a metallurgical vessel, said unit comprising:

refractory material constituting lining of the metallurgical vessel and having a predetermined thickness; and a valve comprising a refractory stator fixed to said refractory material and extending therethrough, and a refractory rotor disposed in said stator and also extending through said refractory lining, said rotor being at least one of longitudinally slidable and rotatable relative to said stator from one side of said refractory lining, said stator having a cylindrical sealing surface therein and a flow control passageway open to said cylindrical sealing surface on the other side of said refractory material, said rotor having a cylindrical sealing surface extending therearound and a flow control passageway open to the cylindrical surface of said rotor on said other side of said refractory material, one of said flow control passageways being open to the exterior of said valve at said other side of said refractory material, the cylindrical sealing surfaces of said stator and said rotor engaging one another to establish a seal over a portion of said stator and said rotor surrounding said flow control passageways, and said rotor being at least one of longitudinally slidable and rotatable between an open position of the valve at which said flow passageways are aligned with each other at said sealing surfaces and a closed position at which the sealing surface of said rotor is disposed over the flow control passageway of said stator so as to limit flow through the valve, and said valve defining a discharge opening therein open at said one side of said refractory material and open to the other of said flow control passageways, and a gap extending over the entire thickness of said refractory material between said stator and said rotor for accommodating for differences in the thermal expansion of said stator and said rotor during the discharging of molten metal through the valve to prevent the valve from jamming during movement of the valve between said positions thereof, the width of said seal between the sealing surfaces of said stator and said rotor being less than the width of said gap between said stator and said rotor.

2. A unit as claimed in claim 1, wherein the inner surface of said stator extending over the thickness of said refractory material and defining said gap with said rotor has a diameter that is larger than the diameter of the sealing surface of said stator.

3. A unit as claimed in claim 1, wherein the rotor is disposed concentrically within said stator and has said discharge opening and said other of said flow control passageways extending therein.

4. A unit as claimed in claim 1, wherein said stator has said discharge opening and said other of said flow control passageways extending therein.

5. A unit as claimed in claim 1, wherein said valve defines an inert gas-feeding passageway therein open to said gap for allowing inert gas to be fed therethrough into said gap defined between said rotor and said stator.

6. A unit as claimed in claim 1, wherein the flow control passageway of said stator is spaced, as taken in the direction of thickness of said refractory material, at least 20 mm from said refractory material.

7. A unit as claimed in claim 1, wherein said discharge opening extends vertically when said refractory material is in place in the metallurgical vessel.

8. A unit as claimed in claim 1, wherein said stator and said rotor each have an annular surface at least one of which annular surfaces extends orthogonally to the cylindrical sealing surfaces, and a second seal is established at the annular surfaces.

9. A unit as claimed in claim 8, wherein each of the at least one annular surfaces are disposed below the cylindrical sealing surfaces.

10. A unit as claimed in claim 8, wherein each of the at least one annular surfaces intersects a respective said cylindrical sealing surface at a right angle.

11. A unit as claimed in claim 8, wherein a ring seal is disposed between said stator and said rotor at said at least one annular surface to establish said second seal.

12. A unit as claimed in claim 1, wherein the portion of said stator and said rotor at which said seal is established between said stator and said rotor is substantially the entire confronting portion of said stator and said rotor that is disposed on the other side of said refractory material.

13. A unit as claimed in claim 1, and further comprising driving means for moving said rotor between the open and closed positions of the valve, said driving means being integral with said rotor at said one side of said refractory material.

14. A unit as claimed in claim 13, wherein said driving means comprises a gear integral with said rotor.

15. A unit as claimed in claim 12, and further comprising driving means for moving said rotor between the open and closed positions of the valve, said driving means being integral with said rotor at said one side of said refractory material.

16. A unit as claimed in claim 15, wherein said driving means comprises a gear integral with said rotor.

17. A unit as claimed in claim 1, wherein said stator has an annular groove extending therein and open at the cylindrical sealing surfaces at a location between the flow control passageway of said stator and said refractory material, and at least one radial opening extending therein between and open to said annular groove and the exterior of said valve.

18. A refractory outer valve part to be used in a valve of a unit for controlling the discharge of molten metal through a nozzle of a metallurgical vessel and fixable within refractory material lining the vessel and defining the nozzle, said refractory outer valve part comprising:

a one-piece refractory sleeve-shaped body having a frustoconical outer peripheral surface to seat the outer valve part in a nozzle of a metallurgical vessel, and an inner peripheral surface comprising a cylindrical sealing surface and an inner surface extending contiguously thereto in the longitudinal direction of the sleeve-shaped body, the inner surface having a diameter that is larger than the diameter of said cylindrical sealing surface, and said sleeve-shaped body defining a flow control passageway therethrough and open to said sealing surface; and wherein said flow control passageway is inclined with respect to the radial direction of the sleeve-shaped body.

19. A refractory outer valve part as claimed in claim 18, wherein said sleeve-shaped body has a closed top end.

20. A refractory outer valve part as claimed in claim 18, wherein said sleeve-shaped body defines an inert-gas feeding passageway therein open to said inner surface for allowing inert gas to be fed through the passageway to said inner surface.

21. A unit as claimed in claim 2, wherein the outer surface of said rotor extending over the thickness of said refractory lining has a diameter that is at least two tenths of a millimeter less than the diameter of the sealing surface of said rotor.

22. A unit as claimed in claim 1, wherein the outer surface of said rotor extending over the thickness of said refractory lining has a diameter that is at least two tenths of a millimeter less than the diameter of the sealing surface of said rotor.

23. A unit as claimed in claim 1, wherein said rotor is both rotatable and longitudinally slidable relative to said stator, from one side of said lining, between the open and closed positions of the valve.

24. A refractory outer valve part to be used in a valve of a unit for controlling the discharge of molten metal through a nozzle of a metallurgical vessel and fixable within refractory material lining the vessel and defining the nozzle, said refractory outer valve part comprising:

a one-piece refractory sleeve-shaped body having a frustoconical outer peripheral surface to seat the outer valve part in a nozzle of a metallurgical vessel, and an inner peripheral surface comprising a cylindrical sealing surface and an inner surface extending contiguously thereto in the longitudinal direction of the sleeve-shaped body, the inner surface having a diameter that is larger than the diameter of said cylindrical sealing surface and said sleeve-shaped body defining a flow control passageway therethrough and open to said sealing surface; and wherein said sleeve-shaped body defines an annular groove open at said sealing surface, and at least one radial opening extending between and open to said annular groove and said outer peripheral surface.

* * * * *